US011408048B2

(12) United States Patent
Xiao

(10) Patent No.: US 11,408,048 B2
(45) Date of Patent: Aug. 9, 2022

(54) HIGH-STRENGTH, HOT ROLLED ABRASIVE WEAR RESISTANT STEEL STRIP

(71) Applicant: TATA STEEL UK LIMITED, London (GB)

(72) Inventor: Bin Xiao, West Midlands (GB)

(73) Assignee: TATA STEEL UK LIMITED, London (GB)

( * ) Notice: Subject to any disclaimer, the term of this patent is extended or adjusted under 35 U.S.C. 154(b) by 78 days.

(21) Appl. No.: 16/615,195

(22) PCT Filed: May 24, 2018

(86) PCT No.: PCT/EP2018/063666
§ 371 (c)(1),
(2) Date: Nov. 20, 2019

(87) PCT Pub. No.: WO2018/215600
PCT Pub. Date: Nov. 29, 2018

(65) Prior Publication Data

US 2020/0157651 A1 May 21, 2020

(30) Foreign Application Priority Data

May 24, 2017 (EP) ..... 17172709
Sep. 22, 2017 (EP) ..... 17192709

(51) Int. Cl.
*C21D 9/52* (2006.01)
*C21D 6/00* (2006.01)
(Continued)

(52) U.S. Cl.
CPC ..... *C21D 9/52* (2013.01); *C21D 6/004* (2013.01); *C21D 6/005* (2013.01); *C21D 6/008* (2013.01);
(Continued)

(58) Field of Classification Search
CPC ..... C21D 2211/004; C21D 2211/008; C21D 6/005; C21D 8/0205; C21D 8/0226; C21D 8/0263; C21D 9/46; C21D 38/00
(Continued)

(56) References Cited

U.S. PATENT DOCUMENTS

2017/0349987 A1 12/2017 Liu et al.

FOREIGN PATENT DOCUMENTS

EP 2592168 A1 5/2013
EP 2759615 A1 7/2014
(Continued)

OTHER PUBLICATIONS

NPL (Hardness conversion table on-line download on 2007). (Year: 2007).*

(Continued)

*Primary Examiner* — Jie Yang
(74) *Attorney, Agent, or Firm* — Vorys, Sater, Seymour and Pease LLP

(57) ABSTRACT

A high strength, hot rolled abrasive wear resistant steel strip with low carbon equivalent values, with a Brinell hardness in the range of 400-465 HBW and a tensile strength in the range of 1180-1500 MPa for strip thicknesses in the range of 3-20 mm, as well as a process for producing such a high strength, hot rolled abrasive wear resistant steel strip.

14 Claims, 1 Drawing Sheet

(51) Int. Cl.

| | |
|---|---|
| ***C21D 8/02*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C21D 8/0205* (2013.01); *C21D 8/0226* (2013.01); *C21D 8/0263* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/004* (2013.01); *C21D 2211/008* (2013.01)

(58) Field of Classification Search
USPC ..... 148/320
See application file for complete search history.

(56) References Cited

FOREIGN PATENT DOCUMENTS

| | | | |
|---|---|---|---|
| EP | 3235923 | A1 | 10/2017 |
| JP | 2012077336 | A | 4/2012 |
| WO | 2016095720 | A1 | 6/2016 |

OTHER PUBLICATIONS

International Search Report and Written Opinion dated Jun. 20, 2018 for PCT/EP2018/063666 to Tata Steel UK Limited filed May 24, 2018.

* cited by examiner

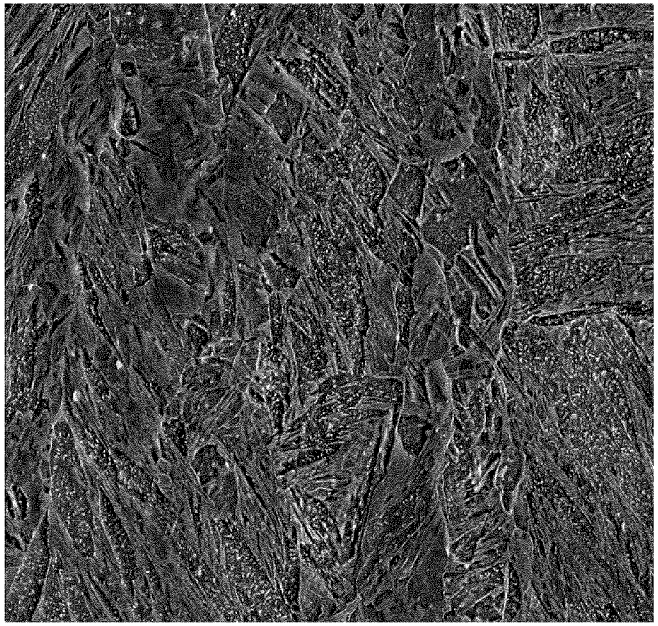

HIGH-STRENGTH, HOT ROLLED ABRASIVE WEAR RESISTANT STEEL STRIP

CROSS-REFERENCE TO RELATED APPLICATIONS

This is a § 371 National Stage Application of International Application No. PCT/EP2018/063666 filed on May 24, 2018, claiming the priority of European Patent Application No. 17192709.8 filed on Sep. 22, 2017 and European Patent Application No. 17172709.2 filed on May 24, 2017.

FIELD OF THE INVENTION

The invention relates to a high strength, hot rolled abrasive wear resistant steel strip and a process for producing such a strip.

BACKGROUND OF THE INVENTION

Hot rolled abrasive wear resistant steel products are typically used in harsh abrasive environments, such as in lifting and excavating applications. Typically the aim of the end users is to extend the service life of these abrasive wear resistant as much as possible in order to reduce maintenance/downtime and therewith the costs.

There is a very strong correlation between the abrasion resistance and the surface hardness of steel, thus to further improve the durability of these abrasive wear resistant steel products, high strength, high hardness as well as high wear resistant properties are required. Therefore, hot rolled martensitic steels with high hardness and desired impact toughness are extensively used in the lifting and excavating industry.

With the continuing development of hot rolled abrasive wear resistant steel strip over the years and a demand for longer service time, the Brinell hardness has been steadily increased resulting in a Brinell hardness of 400 HBW and higher. The general notation to identify the abrasive-resistant steel grades is to classify them according to their surface hardness in terms of Brinell hardness (HBW), and the most common grades are 400 HBW, 450 HBW and 500 HBW. With the increase of the Brinell hardness of the abrasive wear resistant steel strip, such as increasing from 400 HBW to 500 HBW, also the carbon equivalent values (CEV, CET and Pcm) have increased to achieve required hardness and improve hardenability in thicker hot rolled strips, that is in particular with thicknesses of 10 mm and more. This means that even for the same steel grade, such as 400 HBW, different steel composition are needed for the thicker steel strips than for abrasive wear resistant steel strip of less than 10 mm thickness.

Because of the necessary high carbon equivalent values to increase hardness and improve hardenability the different steel compositions used for thicker hot rolled strip have a number of disadvantages. Important properties relating to the processing of these wear resistant hot rolled strip, such as cutting, drilling, bending and welding of the steel strip, deteriorate in comparison with thinner steel strip with lower carbon equivalent values. This results in difficult processing steps with the manufacturing of abrasive wear resistant steel products, which is in particular the case with more complicated products, increasing the costs significantly. To solve this issue, a novel steel composition is designed to have strong strengthening mechanisms to obtain required hardness in thicker strips without increasing the carbon equivalent values noticeably, also the fast and controllable water cooling rate on the run-out table on the hot mill are key factors to produce 400 HBW and 450 HBW grades of hot rolled wear resistant strips that have a thickness in the range of 3-20 mm.

OBJECTIVES OF THE INVENTION

It is an objective of the present invention to provide a high strength, hot rolled abrasive wear resistant steel strip with a Brinell hardness of above 400 HBW and low carbon equivalent values.

It is another objective of the present invention to provide a high strength, hot rolled abrasive wear resistant steel strip with a Brinell hardness of above 400 HBW and low carbon equivalent values with a minimum thickness of 3 mm.

It is another objective of the present invention to provide a high strength, hot rolled abrasive wear resistant steel strip with a Brinell hardness of above 400 HBW and low carbon equivalent values with a thickness in the range of 3-20 mm with a single chemistry composition.

It is another objective of the present invention to provide a high strength, hot rolled abrasive wear resistant steel strip with high impact toughness.

It is another objective of the present invention to provide a high strength, hot rolled abrasive wear resistant steel strip which has good bendability properties.

It is another objective of the present invention to provide a high strength, hot rolled abrasive wear resistant steel strip that can easily be welded.

It is another objective of the present invention to provide a high strength, hot rolled abrasive wear resistant steel strip with high wear resistant.

BRIEF DESCRIPTION OF THE DRAWINGS

FIG. 1 shows a SEM image.

DESCRIPTION OF THE INVENTION

The invention relates to a high strength, hot rolled abrasive wear resistant steel strip with a Brinell hardness of above 400 HBW and low carbon equivalent values and a process for producing such high strength, hot rolled abrasive wear resistant steel strip.

One or more of the objectives of the invention are realized by providing a high strength, hot rolled abrasive wear resistant steel strip, wherein the strip has a thickness in the range of 3-20 mm and has a microstructure comprising martensite, auto-tempered martensite with iron carbides and NbC, Nb(C, N) and NbV(C, N) particles and trace amounts of retained austenite in martensite-austenite islands, with low carbon equivalent values and wherein the steel contains in weight percentages:

C: 0.13-0.29
Si: 0.01-0.05
Mn: 0.5-1.4
Cr: 0.05-0.8
Mo: 0.05-0.4
Ni: at most 0.1
Cu: at most 0.1
Al: 0.01-0.08
Ti: at most 0.02
B: at most 0.004
Nb: 0.005-0.035
V: 0.03-0.20
P: at most 0.020
S: at most 0.010

N: at most 0.006

H: at most 0.0004

Ca additions for sulphide shape control: 0.0005-0.005 wherein the total content of Nb+V is in a range of 0.035-0.16 other elements in amounts of impurity level, balance iron, and wherein CEV is at most 0.46, CET at most 0.34 and Pcm at most 0.32, and wherein the strip has a Brinell hardness of at least 400 HBW and a tensile strength of at least 1316 MPa.

Carbon is the most important element for increasing the hardness and hardenability of martensite. It also improves the strength and wear resistant of the steel strip. In order to ensure that the room temperature surface Brinell hardness and the centre Vickers hardness of the hot rolled strip up to 20 mm are sufficient, the C content is set to not less than 0.13 wt % but not more than 0.29 wt % and preferably in the range of 0.15-0.23 wt %.

Silicon Si acts as a deoxidiser for steelmaking, and Si is an important element for the present invention. The Si content is at the least 0.01 wt % but less than 0.05 wt % in order to get very good surface quality of the hot rolled steel strip. Good surface quality is realised because much less red oxide scales are produced at such low Si content.

Mn increases hardenability of steel and lowers the critical or minimum cooling rate on the run-out table for the martensite formation. However, high levels of Mn do result in high CEV, CET and Pcm levels, which reduces weldability, and promote the harmful banding segregation and adversely affect the homogeneity of the microstructure. In the present invention, the Mn content is controlled at the 0.5-1.4 wt %, and more preferably in the range of 0.6-0.9 wt %.

Cr also enhances the hardenability of the steel and reduces the critical cooling rate for the martensite formation, also Cr can replace Mn content partly to reduce the segregation tendency. However, high levels of Cr do result in poor performance in weldability, thus the Cr content should be in a range of 0.05 to 0.8 wt % or in a more limited range of 0.05 to 0.6 wt %.

Molybdenum Mo can increase quench hardenability of steel significantly and increase hardness of hot rolled strip, also increase tempering resistant. However, higher content of Mo will increase cost and the carbon equivalent values (CEV, CET and Pcm) remarkably, thus the Mo content should be in a range of 0.05 to 0.4 wt %. The Mo content will typically be in a range of 0.05-0.25 wt %, or in a range of 0.1-0.25 wt %.

Niobium Nb is a very important micro-alloying element in the present invention because Nb can be a useful addition below 0.05 wt %. NbC and/or Nb (CN) particles (to fixe some solute N) will be present during the hot forming operation which will help to pin austenite grain boundaries to prevent undesirable austenite grain growth, and hence promote a fine microstructure in the final product. Also the remaining Nb in solid solution at the hot forming temperature can increase hardenability by reducing transformation temperatures. Further during cooling Nb is able to form fine precipitates which could contribute to strength and toughness. However, a high content of Nb will increase the production cost so typically Nb is kept in a range of 0.005 to 0.035 wt %. Nb will typically be in a range of 0.01 to 0.035 wt % or 0.015 to 0.030 wt %.

Vanadium is another important micro-alloying element in the present invention, and V has a similar but less powerful effect as Nb. The addition of both Nb and V further strengthens the hot rolled steel by forming fine Nb and V carbides, nitrides and carbo-nitrides. The addition of V should be within a range of 0.03-0.20 wt %, and will typically be in a range of 0.03-0.15 wt % or 0.03-0.12 wt %. With both Nb and V added into the steel to optimise the strength and toughness level, the content of Nb+V is in the range of 0.06-0.16 wt % and typically in a range of 0.06-0.12 wt %.

Aluminium acts as a strong deoxidisation element to keep the oxygen content as low as possible. Further, Al is combined with free nitrogen N to form AlN precipitates, which can improve the strength, and helps to prevent that boron reacts with nitrogen to form BN precipitates. The Al content should be in the range of 0.01-0.08 wt % and is typically in the range 0.03-0.07 wt %.

Titanium is also combined with carbon and/or nitrogen to form TiC, TiN and/or Ti(C,N) particles, which suppresses austenite grain coarsening during the high temperature reheating stage. However, the large TiC, TiN and/or Ti(C,N) particles are undesirable for the Charpy toughness. Therefore, the Ti content in the present invention should be at most 0.02 wt % and preferably at most 0.01 wt %.

Boron can be effective in promoting higher strength phases such as martensite, by retarding the formation of ferrite during phase transformation on the run out table. The use of Boron could allow a reduction in some of the other alloying elements, resulting in reduced alloying costs and lower carbon equivalent values (CEV, CET and Pcm). It is also important to minimise the formation of BN as this will reduce the "free" boron content for increasing the hardenability. The roles of Ti and Al in the composition according to the present invention is to protect the "free" boron content because Ti and Al can form TiN and AlN respectively, so that only a minimum amount of "free" N can be combined with Boron to form undesired BN. Therefore, Boron content should be in the range of 0.0005 wt % to at most 0.0040 wt %.

Expensive elements such as Cu and Ni could be considered as further strengthening additions, but their effect on strength is relatively modest, and they could only be used in limited amounts to avoid increasing the CEV, CET and Pcm too much. For that reason the content of each of these elements is at most 0.1 wt %.

Calcium additions are added for the Ca treatment of the steel to control sulfide shape and composition; this results in a modification to the MnS inclusions, resulting in an improved Charpy toughness but also improving processability. Other potential improvements associated with Ca additions (and low S) would be a reduction of welding defects such as lamellar tearing. Typical amount of Ca in the invention is 0.0005 to 0.005 wt %. However, when Ca is added excessively, the effect is saturated and the economic efficiency is reduced. Therefore, it is better to Ca level below 0.005 wt %.

P and S must be controlled to low levels to allow good Charpy toughness and weldability to be achieved, and to allow defect free slabs to be produced for rolling to strip.

With this composition the problem of high carbon equivalent values (CEV, CET and Pcm) for higher wear resistant steel grade and in particular strip thicknesses above 10 mm is solved in which these values are kept below certain maximum values. With the wear resistant steel strips according the prior art these values are higher for the higher wear resistant steel grade and for the thicker strips in order to realise the required hardness and hardenability for these higher steel grade and thicker hot rolled strips.

With the above composition the values for the different carbon equivalents are respectively CEV≤0.46, CET≤0.34, and Pcm≤0.32, and more preferably CEV≤0.46, CET≤0.33, and Pcm≤0.31, wherein the carbon equivalent equations for CEV, CET and Pcm values are:

$$CEV=C+Mn/6+Cr/5+Mo/5+V/5+Cu/15+Ni/15;$$

$$CET=C+Mn/10+Mo/10+Cr/20+Cu/20+Ni/40$$

$$Pcm=C+Si/30+Mn/20+Cu/20+Cr/20+Mo/15+V/10+Ni/60+5B$$

An advantage of low carbon equivalent values is that additional weld processing steps such as pre-heating can be avoided, thus reducing fabrication costs.

According to a further aspect the CEV is at most 0.43 and/or CET at most 0.31 and/or Pcm at most 0.29.

The strip with the above composition has a microstructure which comprises martensite, auto-tempered martensite with iron carbides and NbC, Nb(C, N) and NbV(C, N) particles. The microstructure further comprises trace amounts of retained austenite in martensite-austenite (MA) islands. The volume fractions of the martensite content including auto-tempered martensite and MA islands, and lower bainite are depending on the target steel grades and strip thickness. In a typical sample the volume fraction of martensite including auto-tempered martensite and MA islands is 85±3%, and the rest of microstructure is lower bainite that is 15±3% in volume fraction.

According to a further aspect a process is provided for producing a high strength, hot rolled abrasive wear resistant steel strip, wherein the strip has a thickness in the range of 3-20 mm and has a microstructure comprising martensite, auto-tempered martensite with iron carbides and NbC, Nb(C, N) and NbV(C, N) particles and trace amounts of retained austenite in martensite-austenite islands, comprising the steps of:

casting a slab with a composition in wt %

C: 0.13-0.29
Si: 0.01-0.05
Mn: 0.5-1.4
Cr: 0.05-0.8
Mo: 0.05-0.4
Ni: at most 0.1
Cu: at most 0.1
Al: 0.01-0.08
Ti: at most 0.02
B: at most 0.004
Nb: 0.005-0.035
V: 0.03-0.20
P: at most 0.020
S: at most 0.010
N: at most 0.006
H: at most 0.0004
Ca additions for sulphide shape control: 0.0005-0.005 and wherein the total content of Nb+V is in a range of 0.035-0.16, other elements in amounts of impurity level, balance iron, containing the slab in a hot box for a predefined time, reheating the slab to a temperature of at least 1150° C., keeping the slab for a predefined period at the temperature of at least 1150° C., and hot rolling the slab to a hot rolled steel strip with a finish rolling temperature in the range of 800-940° C., water cooling the strip with a cooling rate in the range of −20-150° C./s, coiling the strip at a temperature in the range of 100-250° C.

The slab with the above composition is cast as a slab within a thickness range of 200 to 300 mm from the continuous casting process, or from the thin slab casting process. After casting the hot slab with a maximum temperature in a range of 500-600° C. is contained in the hot box and slowly cooled down for a period in the range of 2-6 days, preferably 3-5 days. The temperature in the hot box is kept at a temperature in a range of 400-500° C. This is a very critical step in the process for the hydrogen diffusing out the slab so that the hydrogen content is less than 1 ppm to minimise the hydrogen embrittlement cracking in such high strength wear resistant steel.

Typically the temperature of the as-cast slab at the end of the period in the hot box is in the range of 400-500° C. After this period in the hot box the slab is reheated to at least 1150° C. and is kept at the temperature of at least 1150° C. for a period of up to 3 hours prior to hot rolling. The initial rough rolling is taking place above recrystallization stop temperature (Tnr>1050° C.) to obtain fine recrystallized grain, while for the finish rolling is performed below Tnr with reduction more than 60% to form heavy deformed pancaked austenite grain size, and the end of finish rolling temperature is in the range 800-950° C. The final thickness of the hot rolled strip is in the range of 3-20 mm.

Immediately after hot rolling, the time between the end of the hot rolling step and the cooling step is kept as short as possible and is preferably less than 10 seconds, and more preferably less than 5 seconds. The thin/thick strip is water cooled on the run-out table with a first defined cooling rate between 40 and 150° C./s for the 450 HBW grade and between 30 and 70° C./s for the 400 HBW from above to the martensite start temperature (Ms) and from the Ms with second defined cooling rate between 25 and 60° C./s for the 450 HBW grade and between 20 and 30° C./s for the 400 HBW to a low coiling temperature in the range of 100-250° C., more preferably in the range of 100-200° C., to ensure its high strength and high hardness. By decreasing the allowable coiling temperature range the homogeneity of the microstructure will improve.

In this important run-out table cooling, the critical fast water cooling rate above martensite start temperature (Ms), and the minimum defined cooling rate (>25° C./s for the 450 HBW steel grade and (>20° C./s for the 400 HBW steel grade) between the Ms and coiling temperature and the final coiling temperature are the essential process parameters. The defined cooling process step between Ms and coiling temperature is very important to realize the fine martensite microstructure and hardness of hot rolled abrasive wear resistant strips. Furthermore, to ensure microstructure and mechanical properties are uniformly distributed through strip thickness and width, the water cooling on the top and bottom of strip surfaces are carefully controlled and optimised.

The final as-coiled microstructure obtained with the above steel composition and process does not result in manganese banding due to the low Mn content. For the present steel composition the Ms temperature is relatively high, that is about 400° C., so the martensite will be auto-tempered to some extent. Therefore, the microstructure is mainly a fine martensite microstructure with small packet and block sizes transformed from the heavy deformed pancaked austenite, lower bainite and auto-tempered martensite with very fine iron carbides, and NbC, Nb(C, N) and NbV(C, N) particles and MA islands to give the balanced properties of high strength, hardness, impact toughness and bendability.

For the 450 HBW steel grade, the volume fraction of martensite including auto-temperature martensite and MA islands is at least 80% and more typically more than 90%, and the lower bainite microstructure is at most 20%, more typically at most 10% in volume fraction. For the 400 HBW steel grade, the volume fraction of martensite including auto-temperature martensite and MA islands is at least 65%, more typically more than 70% and less than 80%, and the rest of lower bainite microstructure is at most 35%, more typically at most 30% and at least 20% in volume fraction.

The key parameters of the process to produce the high strength wear resistant strip Brinell hardness above 400 HBW and low carbon equivalent values and the strip produced according to the process are the steel composition, slow cooling inside the hot box, hot rolling, fast cooling in two stages on the run-out table and low temperature coiling.

The present invention solves the problem that the carbon equivalent values (CEV, CET and Pcm) have to be increased and a different steel composition has to be applied for the higher wear resistant steel grade and thicker strips due to higher hardness requirement in higher steel grade, and the hardenability issue for the thicker hot rolled steel strips in order to maintain a similar hardness level as that of thinner hot rolled strips. Furthermore, the present invention also the problems of lower impact toughness and poorer bendability and weldability properties related to high strength high hardness wear resistant steels and high carbon equivalent values.

Some typical mechanical properties of high strength hot rolled steel strips with different thickness are shown in Table 1 below. With respect to the abrasion resistant property, the common testing standard ASTM G65—the dry sand rubber wheel abrasion test was carried out according to the procedure B—10 minutes testing time. The abrasive material is the rounded quartz grain sand, as specified as AFS 50/70 silica sand, was used for the wear testing. The wear sample weight was measured before and after wear testing with a scale to an accuracy of $10^{-4}$ g to determine weight loss. In Table 1, the relative wear life to reference steel S355 was calculated by weight loss of S355/wear loss of different gauge of hot rolled strips.

TABLE 1

| Gauge (mm) | Steel Grade | Brinell Hardness HBW | YS (MPa) | UTS (MPa) | Elongation A50% | CVN (−40° C.) | R/t | Relative wear life to S355 |
|---|---|---|---|---|---|---|---|---|
| 4 | 450 HBW | 458 | 1208 | 1462 | 10 | N/A | 3 | 2.46 |

TABLE 1-continued

| Gauge (mm) | Steel Grade | Brinell Hardness HBW | YS (MPa) | UTS (MPa) | Elongation A50% | CVN (−40° C.) | R/t | Relative wear life to S355 |
|---|---|---|---|---|---|---|---|---|
| 4.8 | 450 HBW | 456 | 1293 | 1528 | 10 | N/A | N/A | N/A |
| 5 | 450 HBW | 454 | 1242 | 1505 | 10 | N/A | 3 | 2.45 |
| 6 | 450 HBW | 452 | 1258 | 1500 | 11 | 89 J | N/A | N/A |
| 7 | 450 HBW | 451 | 1245 | 1502 | 11 | 84 J | N/A | N/A |
| 8 | 450 HBW | 450 | 1219 | 1459 | 12 | 80 J | 2.5 | 2.37 |
| 8 | 400 HBW | 416 | 1180 | 1385 | 11 | 110 J | 2 | 2.05 |
| 10 | 450 HBW | 446 | 1221 | 1434 | 14 | 73 J | N/A | N/A |
| 10 | 400 HBW | 412 | 1162 | 1316 | 12 | 95 J | N/A | N/A |
| 11 | 450 HBW | 445 | 1183 | 1432 | 16 | 53 J | N/A | N/A |
| 12 | 400 HBW | 400 | 1121 | 1345 | 15 | 61 J | 2 | 1.93 |
| 16 | 400 HBW | 400 | 1127 | 1342 | 15 | 37 J | 2 | 1.71 |

It is clearly shown in Table 1 that the abrasive wear resistant strip product has high strength (≥1500 MPa up to a thickness of 4.2 mm), high elongation (≥10%), high toughness (e.g. for 8 mm 400 HBW grade strip, the Charpy toughness is 110 J at the −40° C.). More importantly, with the present invention two different high strength wear resistant steel grades (400 HBW and 450 HBW) in a wide range of strip thickness can be produced. At the same time the wear resistant hot rolled strips have very low carbon equivalent (CEV, CET and Pcm) values, which means good weldability. The abrasive wear resistant strip also has excellent bendability and abrasive wear resistant properties.

Examples of the steel composition (Code A-M) are given in the Table 2, together with three carbon equivalent values (CEV, CET and Pcm). Please note that the boron content in these examples is about 0.0025 wt % and N content is about 0.005 wt %. The different steels of all examples are calcium treated.

TABLE 2

| Code | C | Si | Mn | Cr | Mo | Ni | Al | Ti | Cu | Nb | V | Nb + V | CEV | CET | Pcm |
|---|---|---|---|---|---|---|---|---|---|---|---|---|---|---|---|
| A | 0.13 | 0.03 | 1.15 | 0.35 | 0.13 | 0.07 | 0.05 | 0.020 | 0.10 | 0.030 | 0.10 | 0.13 | 0.45 | 0.28 | 0.25 |
| B | 0.14 | 0.01 | 1.08 | 0.40 | 0.12 | 0.05 | 0.07 | 0.002 | 0.05 | 0.015 | 0.09 | 0.11 | 0.45 | 0.28 | 0.25 |
| C | 0.15 | 0.03 | 0.88 | 0.21 | 0.20 | 0.05 | 0.06 | 0.010 | 0.06 | 0.024 | 0.12 | 0.14 | 0.41 | 0.27 | 0.25 |
| D | 0.16 | 0.04 | 1.17 | 0.25 | 0.15 | 0.02 | 0.03 | 0.018 | 0.08 | 0.027 | 0.04 | 0.07 | 0.45 | 0.31 | 0.27 |
| E | 0.17 | 0.04 | 1.15 | 0.05 | 0.16 | 0.05 | 0.03 | 0.016 | 0.03 | 0.015 | 0.10 | 0.12 | 0.43 | 0.31 | 0.27 |
| F | 0.19 | 0.03 | 0.52 | 0.40 | 0.20 | 0.08 | 0.06 | 0.020 | 0.07 | 0.026 | 0.10 | 0.13 | 0.43 | 0.29 | 0.28 |
| G | 0.19 | 0.04 | 1.00 | 0.05 | 0.15 | 0.10 | 0.04 | 0.020 | 0.09 | 0.015 | 0.05 | 0.07 | 0.42 | 0.31 | 0.28 |
| H | 0.20 | 0.03 | 0.70 | 0.30 | 0.16 | 0.02 | 0.06 | 0.010 | 0.05 | 0.020 | 0.05 | 0.07 | 0.42 | 0.30 | 0.29 |
| I | 0.21 | 0.04 | 0.70 | 0.20 | 0.20 | 0.02 | 0.07 | 0.002 | 0.02 | 0.025 | 0.07 | 0.10 | 0.42 | 0.31 | 0.30 |
| J | 0.21 | 0.03 | 0.70 | 0.30 | 0.12 | 0.05 | 0.06 | 0.015 | 0.04 | 0.029 | 0.08 | 0.11 | 0.43 | 0.31 | 0.30 |
| K | 0.22 | 0.05 | 0.75 | 0.15 | 0.11 | 0.08 | 0.07 | 0.015 | 0.05 | 0.023 | 0.06 | 0.08 | 0.42 | 0.32 | 0.30 |
| L | 0.23 | 0.04 | 0.70 | 0.10 | 0.10 | 0.05 | 0.07 | 0.020 | 0.02 | 0.025 | 0.05 | 0.08 | 0.40 | 0.32 | 0.30 |
| M | 0.23 | 0.04 | 0.55 | 0.20 | 0.10 | 0.07 | 0.05 | 0.020 | 0.09 | 0.020 | 0.08 | 0.10 | 0.41 | 0.31 | 0.31 |

FIG. 1 shows a SEM image (10816× magnification) of 450 HBW grade from a 4.2 mm high strength wear resistant hot rolled steel strip. The volume fractions of the martensite content including auto-tempered martensite and MA islands, and lower bainite are depending on the target steel grades and strip thickness. In the example of FIG. 1 the volume fraction of martensite including auto-temperature martensite and MA islands is 85±3%, and the rest of microstructure is lower bainite that is 15±3% in volume fraction.

The invention claimed is:

1. A high strength, hot rolled abrasive wear resistant steel strip, wherein the strip has a thickness in the range of 3-20 mm and has a microstructure comprising martensite, auto-tempered martensite with iron carbides and NbC, Nb(C, N) and NbV(C, N) particles and trace amounts of retained austenite in martensite-austenite islands, with low carbon equivalent values CEV, CET and PCM and wherein the steel contains in weight percentages:

C: 0.15-0.29
Si: 0.01-0.05
Mn: 0.6-0.9
Cr: 0.05-0.8
Mo: 0.05-0.4
Ni: at most 0.1
Cu: at most 0.1
Al: 0.01-0.08
Ti: at most 0.02
B: at most 0.004
Nb: 0.005-0.035
V: 0.06-0.15
P: at most 0.020
S: at most 0.010
N: at most 0.006
H: at most 0.0004
Ca additions for sulphide shape control: 0.0005-0.005
wherein the total content of Nb+V is in a range of 0.065-0.16
other elements in amounts of impurity level, balance iron, and
wherein CEV is at most 0.46, CET at most 0.34 and PCM at most 0.32, wherein the strip has a Brinell hardness of at least 400 HBW and a tensile strength of at least 1316 MPa, and wherein CEV, CET and PCM are defined as follows:

$$CEV=C+Mn/6+Cr/5+Mo/5+V/5+Cu/15+Ni/15;$$

$$CET=C+Mn/10+Mo/10+Cr/20+Cu/20+Ni/40;$$

$$PCM=C+Si/30+Mn/20+Cu/20+Cr/20+Mo/15+V/10+Ni/60+5B.$$

2. The strip according to claim 1, wherein the strip up to a thickness of 4.2 mm has a Brinell hardness of at least 458 HBW and a tensile strength of at least 1460 MPa.

3. The strip according to claim 1, wherein the strip at a thickness in the range of 3-16 mm has a Brinell hardness of at least 400 HBW and a tensile strength of at least 1316 MPa.

4. The strip according to claim 1, wherein C is in the range of 0.15-0.23 wt %.

5. The strip according to claim 1, wherein Mo is in a range of 0.05-0.25 wt %.

6. The strip according to claim 1, wherein V is in the range of 0.07-0.15 wt %.

7. The strip according to claim 1, wherein V is in a range of 0.08-0.15 wt %.

8. The strip according to claim 1, wherein V is in the range of 0.09-0.15 wt %.

9. The strip according to claim 1, wherein CEV is at most 0.43, CET is at most 0.31 and PCM is at most 0.29.

10. A process for producing a high strength, hot rolled abrasive wear resistant steel strip, wherein the strip has a thickness in the range of 3-20 mm and has a microstructure comprising martensite, auto-tempered martensite with iron carbides and NbC, Nb(C, N) and NbV(C, N) particles and trace amounts of retained austenite in martensite-austenite islands, with low carbon equivalent values CEV, CET and PCM, comprising the steps of:

casting a slab with a composition in wt %
C: 0.15-0.29
Si: 0.01-0.05
Mn: 0.6-0.9
Cr: 0.05-0.8
Mo: 0.05-0.4
Ni: at most 0.1
Cu: at most 0.1
Al: 0.01-0.08
Ti: at most 0.02
B: at most 0.004
Nb: 0.005-0.035
V: 0.06-0.15
P: at most 0.020
S: at most 0.010
N: at most 0.006
H: at most 0.0004
Ca additions for sulphide shape control: 0.0005-0.005
and wherein the total content of Nb+V is in a range of 0.035-0.16,
other elements in amounts of impurity level, balance iron, and wherein CEV, CET and PCM are defined as follows:

$$CEV=C+Mn/6+Cr/5+Mo/5+V/5+Cu/15+Ni/15;$$

$$CET=C+Mn/10+Mo/10+Cr/20+Cu/20+Ni/40;$$

$$PCM=C+Si/30+Mn/20+Cu/20+Cr/20+Mo/15+V/10+Ni/60+5B;$$

containing the slab in a hot box for a predefined time,
reheating the slab to a temperature of at least 1150° C.,
keeping the slab for a predefined period at the temperature of at least 1150° C., and
hot rolling the slab to a hot rolled steel strip with a finish rolling temperature in the range of 800-940° C.,
water cooling the strip with a cooling rate in the range of −20-150° C./s,
coiling the strip at a temperature in the range of 100-250° C.

11. The process according to claim 10, wherein the slab is contained in the hot box for a period in the range of 2-6 days.

12. The process according to claim 10, wherein the temperature of the slab at the end of the period is in the range of 400-500° C.

13. The process according to claim 10, wherein the slab is kept at the temperature of at least 1150° C. for a period of 0.5-3 hours.

14. The process according to claim 10, wherein the slab is contained in the hot box for a period in the range of 3-5 days.

* * * * *